US005104115A

United States Patent [19]

Saito et al.

[11] Patent Number: 5,104,115

[45] Date of Patent: Apr. 14, 1992

[54] STACKER FOR STACKING AND ISSUING SETS OF CARDS

[75] Inventors: Masami Saito, Tagata; Sakae Shiida, Numazu, both of Japan

[73] Assignee: Tokyo Electric Co., Ltd., Tokyo, Japan

[21] Appl. No.: 577,902

[22] Filed: Sep. 5, 1990

[30] Foreign Application Priority Data

Sep. 7, 1989 [JP] Japan ..... 1-232424

[51] Int. Cl.[5] ..... B65H 39/10

[52] U.S. Cl. ..... 271/185; 271/212; 355/322; 355/323; 101/237; 101/238; 101/240

[58] Field of Search ..... 271/65, 184, 185, 186, 271/176, 212, 225, 176, 303; 400/625; 101/237, 238, 240; 355/318, 322, 323

[56] References Cited

U.S. PATENT DOCUMENTS 4,072,420 2/1978 Wicks et al. ..... 355/100
4,220,323 9/1980 Smith ..... 271/65
4,447,167 5/1984 Euteneuer et al. ..... 400/625
4,502,805 3/1985 Humbs ..... 271/186 X
4,570,801 2/1986 Brannen ..... 271/303 X
4,848,231 7/1989 Stienstra ..... 355/318 X

FOREIGN PATENT DOCUMENTS 0081051 5/1982 Japan ..... 271/186
58-42553 3/1983 Japan .

*Primary Examiner*—H. Grant Skaggs
*Assistant Examiner*—Carol Lynn Druzbick
*Attorney, Agent, or Firm*—Frishauf, Holtz, Goodman & Woodward

[57] ABSTRACT

The stacker for stacking sets of cards comprises a container for receiving a set of boarding passes and a stacking section for stacking these boarding passes in the container in the fixed orientation. In the stacker, the container has first and second walls opposing each other, and the stacking section includes a first ejecting portion for ejecting the boarding pass into the container from the second wall side, such that front of the boarding pass faces the first wall, a second ejecting portion for ejecting the boarding passes into the container from the first wall side, such that the back of the boarding pass faces the second wall, and a feeder for supplying the passes to one of the first and second ejecting portions sequentially.

8 Claims, 6 Drawing Sheets

STACKER FOR STACKING AND ISSUING SETS OF CARDS

BACKGROUND OF THE INVENTION

1. Field of the Invention

The present invention relates to a stacker for stacking a plurality of cards to be issued in a desired order.

2. Description of the Related Art

All airlines operate a boarding procedure for departing flights, and issue the required number of boarding passes to passengers by means of a boarding pass issuing device. The boarding passes each include flight information comprising the flight number, flight departure time passenger seat number, the passenger's name, and other details.

In the case of a conventional boarding pass issuing device, a continuous form is cut at fixed intervals, the relevant flight information being printed on the front surface of each cut form, and a printed card being conveyed to a container as a boarding pass. When a given set of boarding passes is printed, the boarding passes are stacked sequentially in a container such that the front of each one faces the back of the one immediately preceding it. The boarding passes are removed from the container after the final one of the set has been conveyed thereto. The order of the boarding passes is designated by the user, i.e., the airline, in seat number order, such as from the lowest to the highest seat number, as shown in FIG. 1, or, as is shown in FIG. 2, from the highest to the lowest seat number. In FIGS. 1 and 2, the seat numbers are indicated as SN1, SN2, . . . SNn.

Recently, the passenger counter is, in some cases, shared by some air companies, each using the counter for some time for its departure flight. In this case, the boarding passes issuing device has to supply both demands of order from small to large number of seat and of order from large to small number of seat. The memory incorporated in the conventional boarding passes issuing device stores a plurality of flight data items supplied from a host computer of each air company, and these data items are read from the memory in the order the boarding passes have been designated, and are printed on the boarding passes.

The above-mentioned memory needs to have sufficient memory capacity large enough to store all needed flight information. Further, since printing process starts after the all flight information supplied from the host computer is stored in the memory, a long time is required for preparing the printing, in comparison with the case where the printing process is achieved directly according to each flight information supplied from the host computer.

SUMMARY OF THE INVENTION

The object of the present invention is to provide a stacker for issuing cards, in which the order the cards are stacked having recorded information can be changed easily.

According to the present invention, there is provided a stacker for issuing sets of cards, comprising: a card container for receiving a set of cards, having first and second walls opposing each other; a first ejecting portion for ejecting the cards into the container from the second wall side so that the front of each card faces the first wall; a second ejecting portion for ejecting the cards into the container from the first wall side so that the back of each card faces the second wall; and a feeder for supplying the cards to one of first and second ejecting portions sequentially.

The order the cards are stacked in the card container can be reversed by selecting an ejecting portion. When the first ejecting portion is selected, and a set of cards are sequentially supplied into the first ejecting portion from the feeder, the cards are ejected into the container from the second wall side so that the front of each card faces the first wall of the container. After the first card is put into the container, the other cards are stacked sequentially on the back of the card previously put in. On the other hand, when the second ejecting portion is selected, and a set of cards are sequentially supplied to the second ejecting portion from the feeder, the cards are ejected into the container from the first wall side so that the back of each card faces the second wall of the container. After the first card is put into the container, the other cards are stacked sequentially on the front of the card previously put in. Namely, in the case where the feeder supplies a set of cards, which have serial numbers printed on the fronts, to the first or second ejecting portion, the cards ejected from the first ejecting portion are stacked in the order reverse to those ejected from the second ejecting portion. Further, the cards can be guided to the first or second wall side and set in the same orientation, without using any complicated mechanism.

If the stacker is used in, for example, a card issuing apparatus, the pieces of information supplied sequentially from an external device can be printed on the cards directly. Accordingly, the pieces of information corresponding to all cards need not be temporarily stored in the memory and read out from the memory in the order the cards should be stacked.

DETAILED DESCRIPTION OF THE PREFERRED EMBODIMENTS

A boarding pass issuing device according to one embodiment of the present invention will now be described, with reference to FIGS. 3 to 7.

Figure 1:
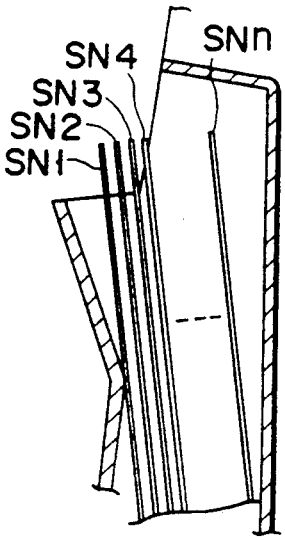
FIG. 1 PRIOR ART
FIGS. 1 and 2 illustrate boarding passes stacked in the container of a conventional boarding pass issuing device in the ascending order of seat numbers and in the descending order thereof, respectively.
Figure 2:
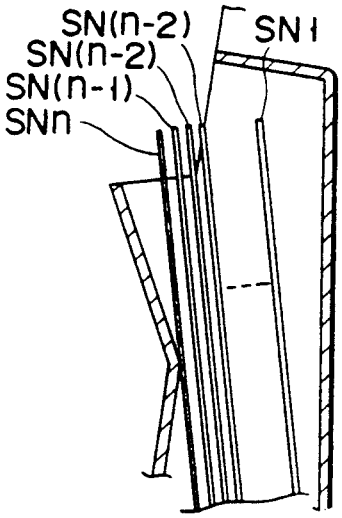
FIG. 2 PRIOR ART
Figure 4:
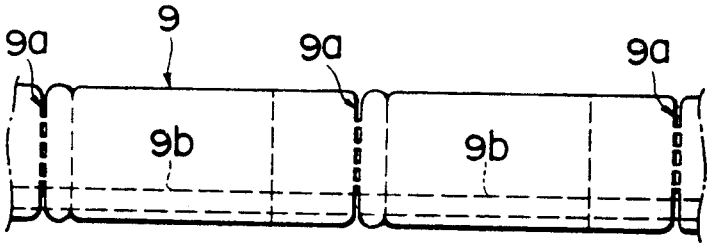
FIG. 4 illustrates for the boarding pass form put in a stacker of FIG. 3.
Figure 3:
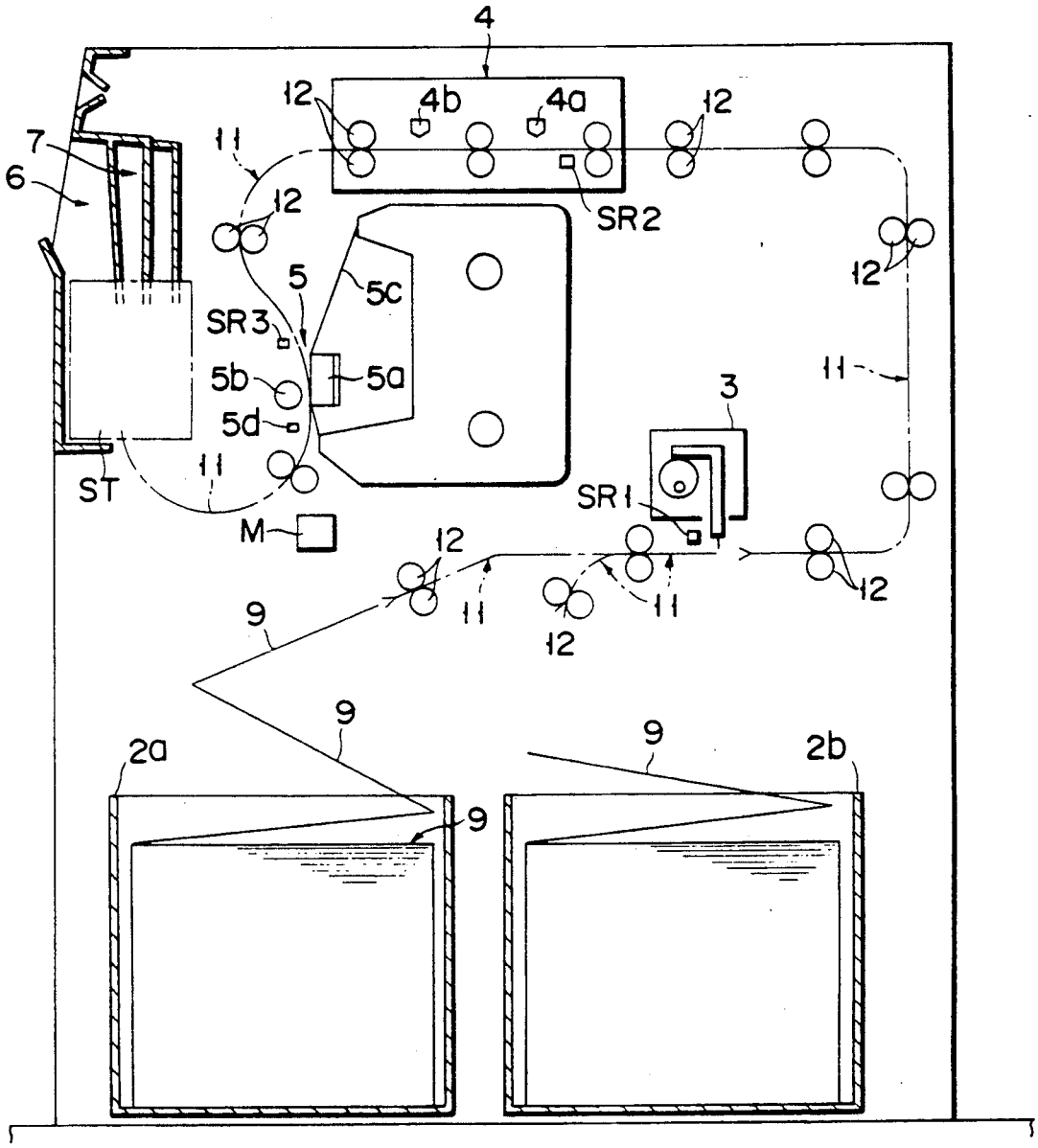
FIG. 3 is a schematic view showing the internal structure of the boarding pass issuing device according to one embodiment of the present invention.

FIG. 3 schematically shows the internal structure of the boarding pass issuing device and FIG. 4 shows a boarding pass form. The boarding pass issuing device has stackers 2*a* and 2*b* for holding boarding pass forms 9, a carrier path 11 for the boarding pass forms, a plurality of rollers 12 arranged on the carrier path 11, for carrying the forms 9 along the path 11, a motor M for driving the rollers 12, and paper sensors SR1, SR2 and SR3. The boarding pass issuing device contains further comprises a burster unit 3, a magnetic recording unit 4, a printing unit 5, and a stack unit ST—all located along the carrier path 11. Stackers 2*a* and 2*b* store the boarding pass form 9 and are selectively used at the time of issuing the boarding passes. The boarding pass forms 9 each include scores 9*a* marked at fixed intervals and a magnetic stripe 9*b* formed on back, as is shown in FIG. 4. The burster unit 3 cuts each form 9 supplied from either the stocker 2*a* or 2*b* along with the score 9*a*. The magnetic recording unit 4 records the flight information on a magnetic stripe 9*b* of the form 9 supplied from the burster unit 3. The printing unit 5 prints the flight information on the front of the form 9 supplied from the magnetic recording unit 4. The stack unit ST stacks, in a specific orientation the forms 9 sequentially supplied, as the boarding passes from the printing unit 5. The magnetic recording unit 4 comprises a write head 4*a* and a readout head 4*b*. The printing unit 5 comprises a printing head 5*a*, a platen 5*b*, an ink ribbon 5*c*, and a printing density sensor 5*d*.

Figure 5:
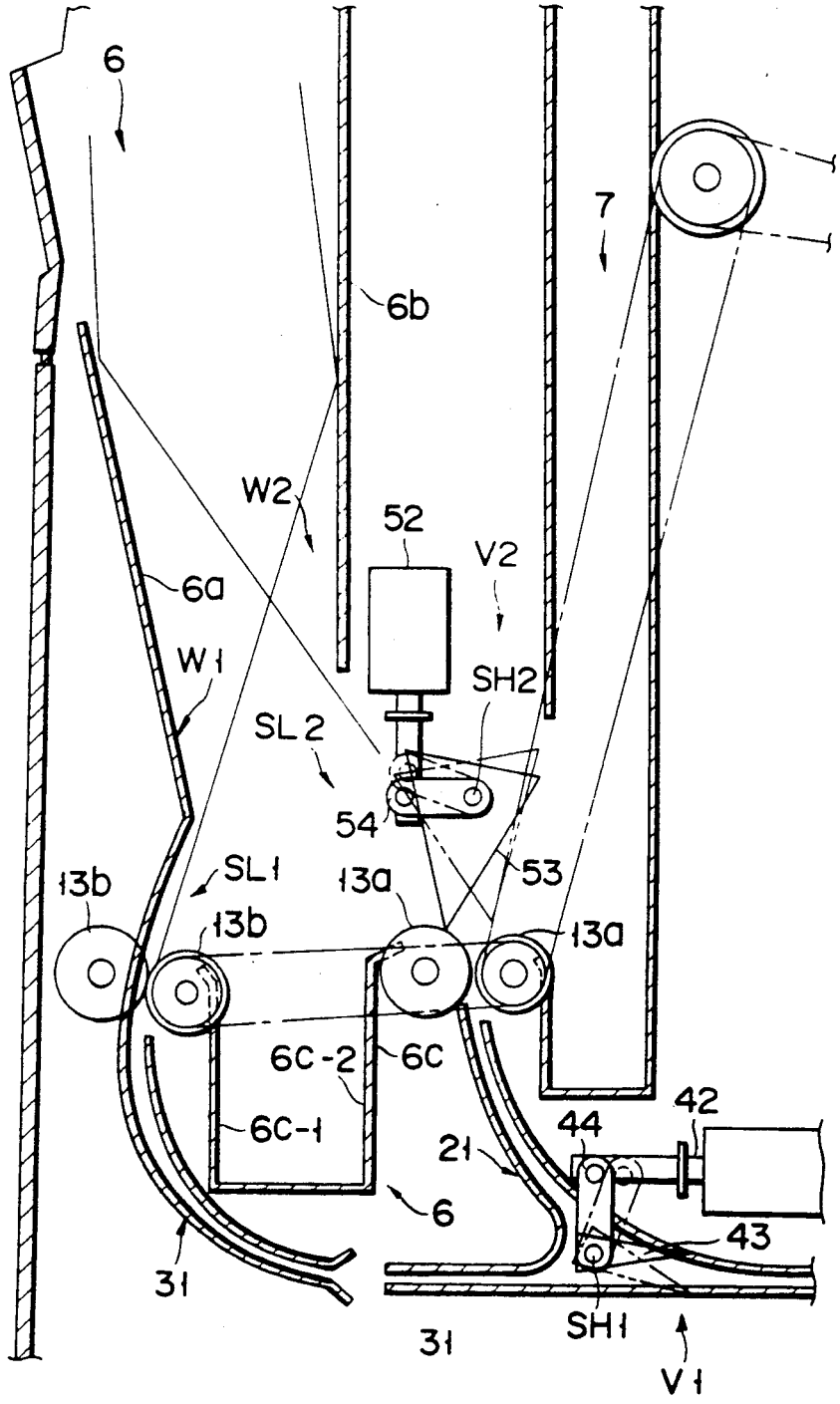
FIG. 5 illustrates the structure of the stack portion of FIG. 3, in greater detail.

FIG. 5 shows a stack unit ST in detail. The stack unit ST has a storage 6 for receiving the boarding passes, a void bin 7 for receiving defective boarding passes, first and second ejecting rollers 13 for ejecting the boarding passes 9 into the storage 6, first and second ejecting paths 21 and 31 for leading the boarding passes 9 into the first and second ejecting rollers 13*a* and 13*b*, a first feed selector V1 for supplying the boarding passes 9 into the first ejecting path 21 or the second ejecting 31, and a second feed selector V2 for supplying the boarding passes 9 into one of the storage 6 and the void pin 7. The storage 6 has first and second guides 6*a* and 6*b* and a holder 6 located under the guides 6*a* and 6*b*. The first guide 6*a* and one portion 6*c-a* of holder 6*c* form the first wall W1 of the storage 6, and the second guide 6*b* and the one portion 6*c*-2 of holder 6 form the second wall W2 of the storage 6. The first wall W1 opposes the second wall W2. First and second slots SL1 and SL2 are formed in the walls W1 and W2, respectively. The guide 6*a* is formed integrally with the one portion of second ejecting path 31 as shown in FIG. 5.

The first and second ejecting rollers 13*a* and 13*b* are provided at one end of the first and second ejecting paths 21 and 31, respectively. The ejecting paths 21 and 31 are connected at the other end to the carrier path 11 as a branch path. The first feed selector V1 comprises a solenoid 42, a flap 43, and an arm 44. The flap 43 is rotatable around a shaft SH1 located at the position where the ejecting paths 21 and 31 are connected to the carrier path 11. The flap 43 is connected to the solenoid 42 through the arm 44. The solenoid 42 is driven to set the flap 43 into an operative position as is shown by the solid line, or into a rest position as is shown by the two-dot, one-dash line. The boarding pass 9 is guided from the carrier path 11 to the first ejecting path 21 when the flap 4 is in the rest position. It is guided from the carrier path 11 to the second ejecting path 31 when the flap 44 is in the operative position. The second feed selector V2 comprises a solenoid 52, a flap 53, and an arm 54. The flap 53 is rotatable around a shaft SH2 provided in the axis of the ejecting path 21, and the flap 53 is connected to the solenoid 52 by the arm 54. The solenoid 52 is driven, setting the flap 53 into an operative position as is shown by the solid line, or into a rest position as is shown by the two-dots, one-dash line. The boarding pass 9 is guided from the ejecting path 21 to the storage 6 when the flap 54 is in the rest position. It is guided from the carrier path 21 to the void bin 7 when the flap 44 is in the operative position. The first and second ejecting rollers 13*a* and 13*b* are connected by a belt to the motor M shown in FIG. 3.

Figure 6:
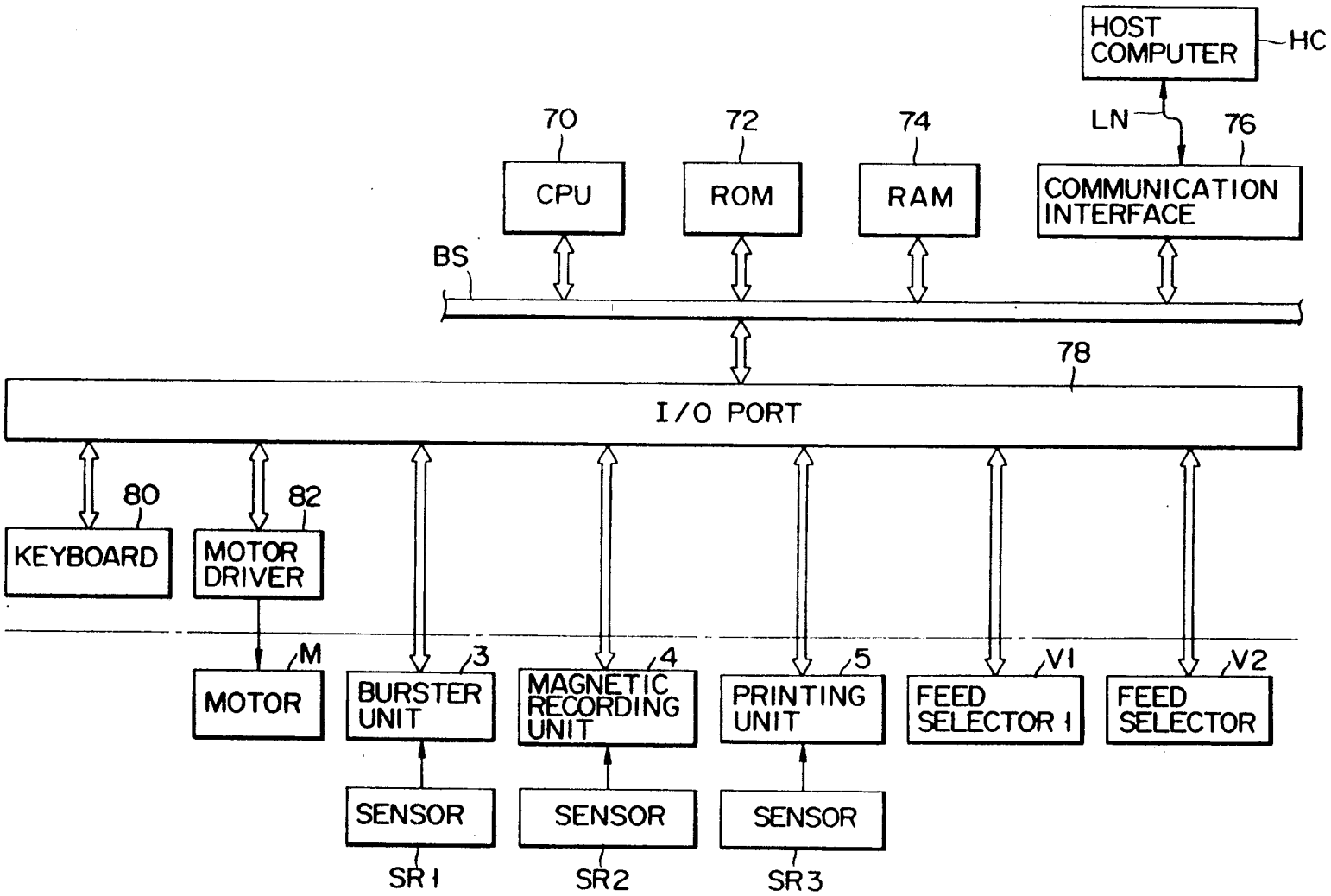
FIG. 6 is a diagram showing the control circuit of the device of FIG. 3.

FIG. 6 is a diagram showing the control circuit of the boarding pass issuing device. The control circuit has CPU 70, ROM 72, RAM 74, a communication interface 76, an I/O port 78, a keyboard 80, and a motor driver 82. The CPU 70, ROM 72, RAM 74, and communication interface 76 are connected to the I/O port 78 through a bus BS2. The communication interface 76 is connected to the host computer HC of the air company through a communication line LN. The I/O port 78 is connected to the keyboard 80, motor driver 82, burster unit 3, magnetic recording unit 4, printing unit 5, and first and second feed selectors V1 and V2. The sensors SR1, SR2 and SR3 are connected to the burster unit 3, magnetic recording unit 4, and printing unit 5, respectively. The ROM 72 stores a control program and fixed data for the CPU 70. The RAM 74 stores variable data which is input to and output from the CPU 70. The CPU 70 performs various calculating operations and control operations, by executing the control program stored in ROM 72. The fixed data includes, for example, the order of boarding passes designated by the air companies. The variable data includes, for example, the number of boarding passes and flight information to be issued. The flight information is stored from the host computer HC into RAM 70 during the process for issuing the boarding passes HC. The keyboard 80 is operated, for example, to designate the air companies, to input flight number of the departure flight, to change the order of boarding passes based on the decision of the operator, and to direct the issuance of boarding passes. The burster unit 3, the magnetic recording unit 4, and the printing unit 5 are actuated after the corresponding sensors SR1, SR2 and SR3 detect a form.

Figure 7:
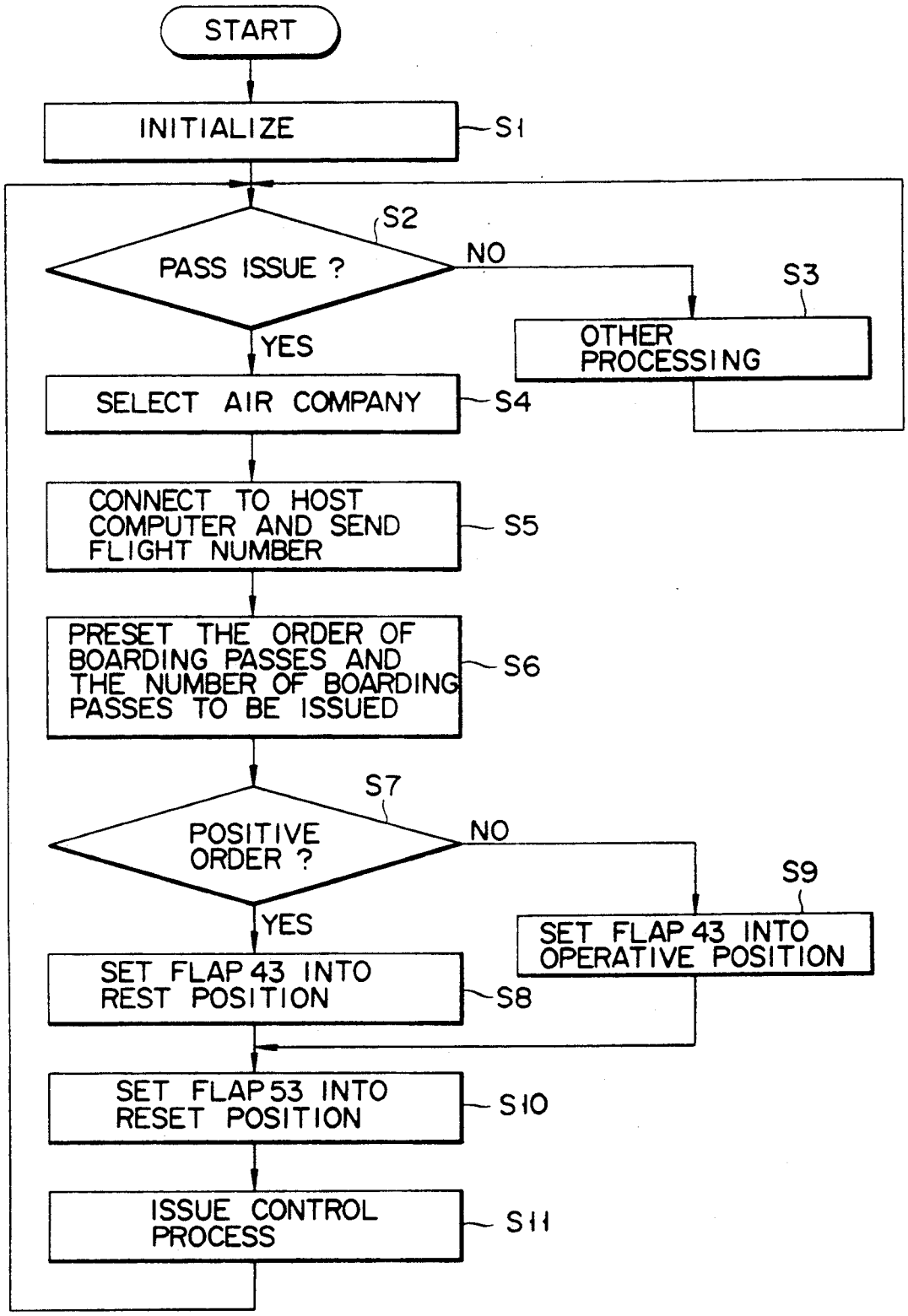
FIGS. 7 and 8 are flow charts explaining the operation of the device of FIG. 3.

The operation of this boarding pass issuing device will be explained, with reference to FIGS. 7 and 8. When the issuing device is turned to ON, CPU 70 starts it's processings as shown in FIG. 7. At the first step S1, each circuit element is initialized, and as to whether the order of issuing boarding pass is input or not is checked in step S2. In the case where the order is not input, the other processings are achieved in the step S3, and again step S2 is performed. In the case where the order is input, one of the air companies is selected in step S4, and the control circuit is connected to the host computer HC of the selected air company, whereby the flight number is supplied in accordance with the keyed input in step S5. In step S6, the order of boarding passes corresponding to the selected air company is preset, and the number of boarding passes to be issued corresponding to the flight number is preset. In step S7 checks it is determined whether the resulting order is positive or not. If it is positive, the flap 43 is set into the rest position in step S8. If it is not positive, the flap 43 is set into the operative position in step S9. In step S10, the flap 53 is set into the rest position, and the issuance of the boarding pass is controlled in the step S11.

Figure 8:
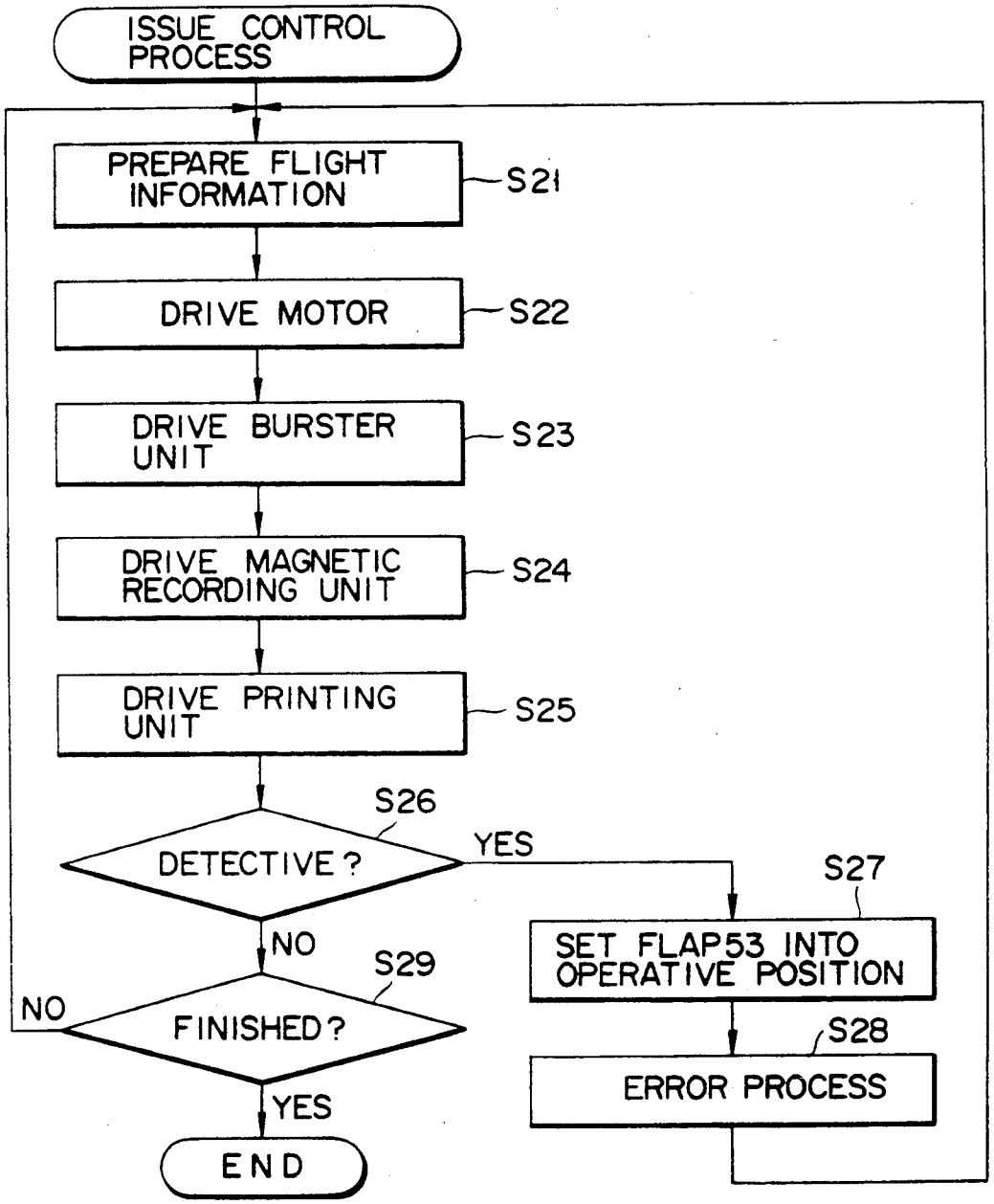

FIG. 8 explains how the issuing of boarding passes is controlled. First the flight information is prepared in step S21. The motor M is driven in step S22. The the burster unit 3 is driven in step S23. The magnetic recording unit 4 is driven in step S24. The printing unit 5 is driven in step S25. In step S26, it is checked as to whether the defective boarding pass is detected by the read-out head 4*b* and the print density sensor 5*d*. If such a defective pass is detected, the flap S3 is set into the operative position in step S26, and the process returns to the step S21 after an error . process is finished in step S27. If such a defective pass is not detected, it is checked in step S28 as to whether all boarding passes are issued. If all boarding passes are not finished, step S21 is again performed for next issuance of boarding passes. If all boarding passes are finished, the host computer HC is released to stop the motor M, and the process returns to the step S2 as shown in FIG. 7.

In this embodiment, the burster unit 3 cuts the boarding pass forms sequentially supplied from, for example, the stacker 2*a*. Each boarding pass form is supplied to the stack unit ST through the carrier path 11, further through the magnetic recording unit 4 and the printing unit 5. The magnetic recording unit 4 records the flight information on the magnetic strip formed on the backs of the boarding passes form supplied from the burster unit 3 sequentially in the order of the seat numbers. The printing unit 5 prints the same flight information on the front surfaces of the boarding pass forms sequentially supplied from the magnetic recording unit 4. The stack unit ST receives the boarding pass forms sequentially supplied from the printing unit.

In the case where the order of the boarding pass is positive, each boarding pass is guided into the first ejecting path 21 by the flap 43 of the first feed selector V1, and is ejected from the ejecting roller 13*a*. The pass, thus ejected, is guided into the storage 6 by the flap 53 through the slap SL2. It is lifted temporarily along the guide 6*a* by the rotating force of the ejecting roller 13*a*, and then drops to onto the holder 6*c*. When the first boarding pass is put in, with its front facing the wall W1, the next boarding pass is put similarly and is stacked on the back of the previously ejected boarding pass.

On the other hand, when the order of the boarding pass is not positive, each boarding pass is guided into the second ejecting path 31 by the flap 43 of the first feed selector V1, and is ejected from the ejecting roller 13*b*. The pass, thus ejected, is guided into the storage 6 through the slot SL2. It is lifted temporarily along the guide 6*b* by the rotating force of the ejecting roller 13*b* and drops onto the holder 6*c*. When the first boarding pass is put in, with its back facing the wall W2, the next boarding pass is put similarly and is stacked on the front of the previously ejected boarding pass.

The defective boarding pass is guided into the second ejecting path 31 by the flap 43 of the first feed selector V1 and is ejected from the ejecting roller 13*b*. The ejected boarding pass is guided by the flap 53 and put in the void bin 7.

With the present embodiment, it is possible to record the flight information sequentially supplied from the external host computer HC, directly on the plurality of the boarding passes. Accordingly, the flight information corresponding to all boarding passes need not be temporarily stored in the memory, and the flight information need not be read out from the memory in the order the boarding passes should be stacked.

What is claimed is:

1. A stacker for stacking sets of cards, the cards having front and back surfaces, the stacker comprising:

a card container for receiving a set of cards, said card container having first and second spaced apart walls opposing each other;

first ejecting means for ejecting the cards into said card container from the second wall side of the card container with the front surfaces of the cards facing said first wall to thereby arrange the cards in a direction from said first wall side to said second wall side with the front surface of each card facing said first wall;

second ejecting means for ejecting the cards into said card container from the first wall side of said card container with the front surfaces of the cards facing said first wall to thereby arrange the cards in a direction from said second wall side to said first wall side with the front surface of each card facing said first wall; and feeding means for supplying the cards to one of said first and second ejecting means sequentially.

2. A stacker according to claim 1, wherein said feeding means includes stack control means for determining an order of the set of cards and allowing the cards to be supplied to the ejecting means corresponding to the order.

3. A stacker according to claim 2, wherein said card container further includes first and second slots formed in said first and second walls, respectively.

4. A stacker according to claim 3, wherein said first ejecting means includes a first ejector for ejecting cards into said container through said second slot, and said second ejecting means includes a second ejector for ejecting cards into said container through said first slot.

5. A stacker according to claim 4, wherein said first ejector includes a pair of ejecting rollers located adjacent to said second slot and an ejecting path formed between the ejecting roller pair thereof and and said feeding means, said second ejector includes a pair of ejecting rollers located adjacent to said first slot and an ejecting path formed between the ejecting roller pair thereof and said feeding means.

6. A stacker according to claim 5, wherein said feeding means includes means defining a feeding path connected to the ejecting paths of said first and second ejectors, and a flap located at a position where said feeding path is connected to said ejecting path, for guiding cards supplied from said feeding path to one of the ejecting paths of said first and second ejectors.

7. A stacker according to claim 2, wherein said stack control means includes removing means for removing defective cards.

8. A stacker according to claim 7, wherein said removing means includes a void bin for receiving the defective cards, and a flap located between said container and one of said first and second ejecting means, for guiding the defective cards to said void bin.

* * * * *

UNITED STATES PATENT AND TRADEMARK OFFICE

CERTIFICATE OF CORRECTION

PATENT NO. : 5,104,115

DATED : April 14, 1992

INVENTOR(S) : SAITO et al

It is certified that error appears in the above-identified patent and that said Letters Patent is hereby corrected as shown below:

Title page:

Section [56] References Cited, under "Foreign Patent Documents", insert the following reference:

-- 63-136 297 6/1988 Japan --.

Signed and Sealed this

Twenty-fifth Day of May, 1999

*Attest:*

Q. TODD DICKINSON

*Attesting Officer*

*Acting Commissioner of Patents and Trademarks*